US006334313B1

(12) United States Patent
Nagaishi et al.

(10) Patent No.: US 6,334,313 B1
(45) Date of Patent: Jan. 1, 2002

(54) APPARATUS FOR COOLING SUPERCONDUCTOR

(75) Inventors: Tatsuoki Nagaishi; Hideo Itozaki, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/458,695

(22) Filed: Dec. 13, 1999

(30) Foreign Application Priority Data

Dec. 11, 1998 (JP) ..... 10/353163

(51) Int. Cl.[7] ..... F25B 41/06
(52) U.S. Cl. ..... 62/51.1
(58) Field of Search ..... 62/51.1, 259.2

(56) References Cited

U.S. PATENT DOCUMENTS

| | | | | |
|---|---|---|---|---|
| 4,655,045 A | * | 4/1987 | Matsumoto et al. | 62/45 |
| 5,248,365 A | | 9/1993 | Kamioka et al. | |
| 5,375,423 A | * | 12/1994 | Delatte | 62/45.1 |
| 5,861,574 A | * | 1/1999 | Kotani et al. | 174/15.4 |
| 5,894,220 A | | 4/1999 | Wellstood et al. | 324/248 |

FOREIGN PATENT DOCUMENTS

| | | |
|---|---|---|
| EP | 0 549 463 | 6/1993 |
| GB | 1 294 995 | 11/1972 |

OTHER PUBLICATIONS

Lee et al., High–transition temperature superconducting quantum interference device microscope, Rev. Sci.. Instrum., vol. 67, No. 12, (1996), pp. 4209–4215.

Hibbs et al.; "High–resolution Magnetic Imaging System Based on a SQUID Magnetometer"; Review of Scientific Instruments; US American Institute of Physics; vol. 63, No. 7, Jul. 1, 1992; pp. 3652–3658; XP000310653.

European Search Report dated Jan. 29, 2001.

* cited by examiner

*Primary Examiner*—William Doerrler
*Assistant Examiner*—Malik N. Drake
(74) *Attorney, Agent, or Firm*—Foley & Lardner

(57) ABSTRACT

In the apparatus for cooling a superconductor in accordance with the present invention, a male thread portion of an inner container engages a female thread portion of an outer container so as to connect the inner and outer containers to each other. Also, the bottom wall of the inner container is provided with a thermal conductor penetrating therethrough. Further, a sapphire sheet is joined to peripheral portions of an opening of the bottom wall of the outer container facing the thermal conductor, so as to block the opening. As the distance between the bottom wall of the outer container and the bottom wall of the inner container is freely adjusted by changing the engaging position between the thread portions, the gap between a high transition temperature (high $T_c$) superconducting magnetic sensor and the sapphire sheet is adjusted.

6 Claims, 5 Drawing Sheets

APPARATUS FOR COOLING SUPERCONDUCTOR

BACKGROUND OF THE INVENTION

1. Field of the Invention

The present invention relates to apparatus for cooling superconductor; and, in particular, to heat insulation type apparatus for cooling superconductor.

2. Related Background Art

As a conventional apparatus for cooling a superconductor, a heat insulation type cooling apparatus for cooling a superconducting quantum interference device (SQUID) to a superconductivity transition temperature ($T_c$) or lower is reported in a literature (T. S. Lee et al., Rev. Sci. Instrum., 67(12), 1996). This cooling apparatus has an outer container, an inner container accommodating liquid nitrogen, and a thermal conductor for conducting the heat of liquid nitrogen. The cooling apparatus is also equipped with a position adjusting mechanism for adjusting the gap between a SQUID chip attached to the front end of the thermal conductor and a vacuum window of a cup-shaped assembly attached to the outer container.

SUMMARY OF THE INVENTION

As a result of diligent studies, the inventors have found that the above-mentioned cooling apparatus has the following problems. Namely:

1) The position adjusting mechanism and other constituent parts have a large number of components, and a bellows is necessary for allowing the cup-shaped assembly to move up and down, whereby the apparatus tends to be complicated and expensive.

2) Since the thermal conductor is elongated due to the structure of the apparatus, the efficiency of cooling the SQUID chip is not always sufficient. Also, the thermal conductor comprises a copper rod and a sapphire rod which are connected to each other. When different kinds of members are thus connected to each other, the thermal conductivity deteriorates at the junction therebetween, thus yielding a possibility that the efficiency of cooling the SQUID chip further decreases.

3) Since the structure of the apparatus is complicated, assembling and maintaining operations are cumbersome. Therefore, an improvement is desired in workability y at the time of assembling and maintenance.

In view of such circumstances, it is an object of the present invention to provide a cooling apparatus for a superconductor, which can be made at a lower cost as compared with conventional ones, is excellent in cooling performances, and is capable of improving the workability.

The inventors have further conducted studies based on the above-mentioned findings, thereby accomplishing the present invention. Namely, the apparatus for cooling a superconductor in accordance with the present invention comprises an outer container, substantially shaped like a cup, comprising a female thread portion at an inner peripheral face of an open end thereof and a window at a bottom wall thereof; an inner container, substantially shaped like a cup and disposed within the outer container, having an outer peripheral face of an open end thereof provided with a male thread portion adapted to engage the female thread portion; and a thermal conductor, disposed at a position facing the window so as to penetrate through the inner container, having one end positioned inside the inner container and the other end positioned outside the inner container, the other end having a superconductor attached thereto; wherein a space between the outer container and inner container defined by the engagement of the female thread portion and the male thread portion is vacuumed so as to form a vacuum heat-insulating layer. At the time of cooling the superconductor, a coolant for cooling the superconductor is accommodated inside the inner container.

Preferably, a lead for transmitting information obtained by the superconductor is connected to the superconductor, and the inner container is formed with an outlet for drawing out the lead therethrough.

Preferably, the apparatus further comprises an annular sealing member, disposed within the vacuum heat-insulating layer, abutting against both of the inner and outer containers at a part on the inner side of the vacuum heat-insulating layer than the engaging part of the female and male thread portions, so as to seal the vacuum heat-insulating layer.

Preferably, in this case, the apparatus further comprises a bypass member, disposed within the inner container, having one end connected to a part of the inner periphery of the inner container below the sealing member and the other end connected to a part of the inner periphery of the inner container above the sealing member, for bypassing thermal conduction from the coolant with respect to the sealing member. It is further preferred that the inner container be made of fiber-reinforced plastics.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, embodiments of the present invention will be explained in detail with reference to the accompanying drawings. Here, elements identical to each other will be referred to with numerals identical to each other, without repeating their overlapping explanations.

Figure 1:
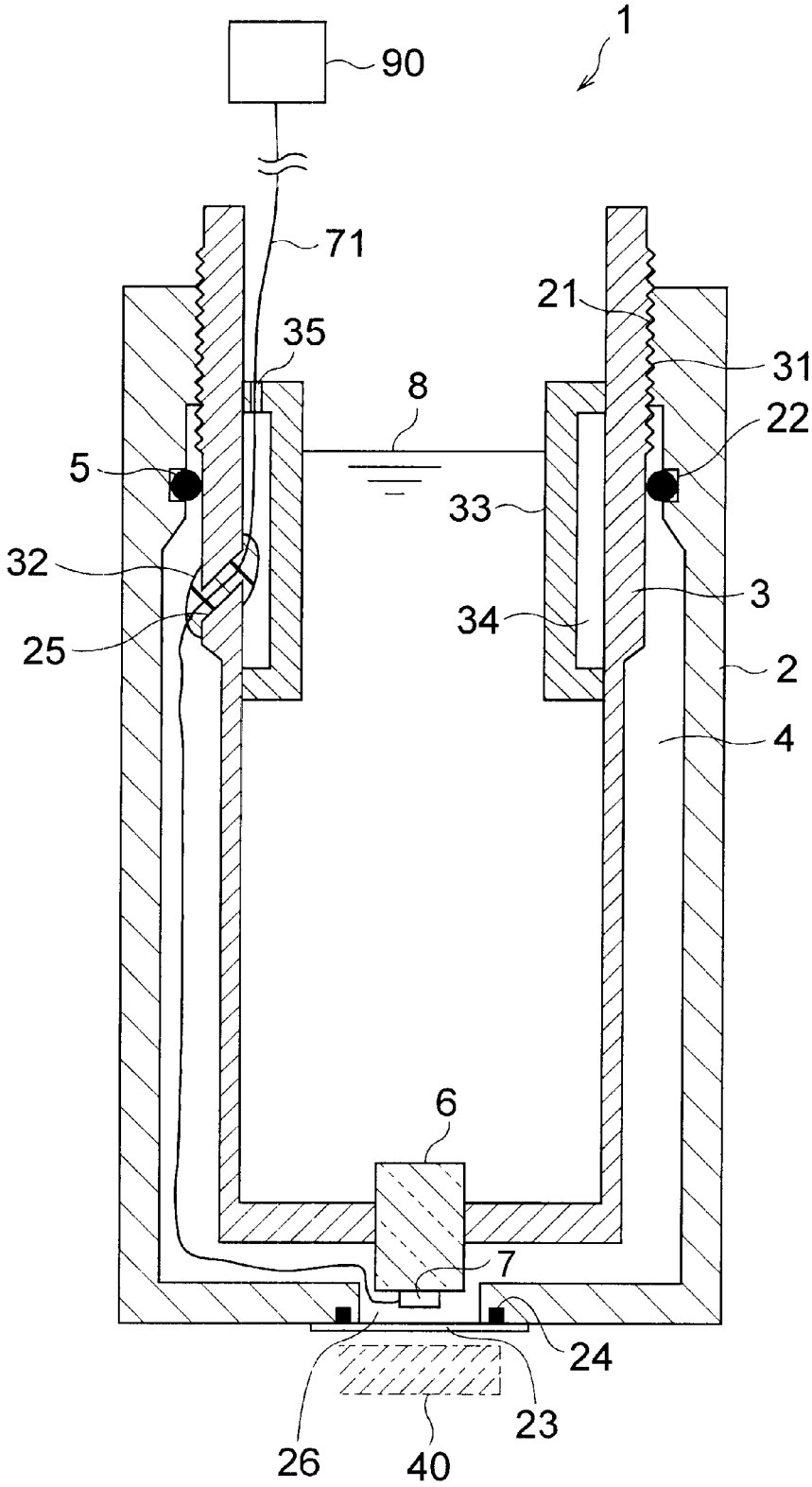
FIG. 1 is a sectional view schematically showing the configuration of a first embodiment concerning the apparatus for cooling a superconductor in accordance with the present invention.

FIG. 1 is a sectional view schematically showing the configuration of a first embodiment concerning the apparatus for cooling a superconductor in accordance with the present invention. As shown in FIG. 1, the cooling apparatus 1 (apparatus for cooling a superconductor) comprises a substantially cup-shaped outer container 2 made of glass fiber reinforced plastics (GFRP), and a substantially cup-shaped inner container 3 made of GFRP disposed therewithin such that their bottom walls face each other. Within the inner container 3, liquid nitrogen 8 as a coolant is accommodated. GFRP has a thermal conductivity lower than that of metals, and a nonmagnetic characteristic.

Also, the inner peripheral face of the open end of the outer container 2 is provided with a female thread portion 21. On the other hand, the outer peripheral face of the inner container 3 is provided with a male thread portion 31 adapted to engage the female thread portion 21. As these thread portions 21, 31 engage each other, the outer container 2 and the inner container 3 are connected to each other. Also, the pressure in the inner space defined by this engagement between the outer container 2 and the inner container 3 is reduced to a near vacuum. This state is maintained, as will be explained later, so as to form a vacuum heat-insulating layer 4.

At a part of the inner periphery of the outer container 2 on the inner side of the vacuum heat-insulating layer 4 than the engaging part between the female thread portion 21 and the male thread portion 31 (near the engaging part) within the vacuum heat-insulating layer 4, an annular groove 22 is formed. An O ring 5, as a sealing member, is installed in the annular groove 22. The O ring 5 is pressed against the outer periphery of the inner container 3, whereby the near vacuum state is held in the vacuum heat-insulating layer 4.

Also, an annular bypass member 33 is installed inside the inner container 3 on the upper end side thereof. The lower end of the bypass member 33 is connected to the inner periphery of the inner container 3 at a part lower than the O ring 5. Also, the upper end of the bypass member 33 is connected to the inner periphery of the inner container 3 at a part higher than the O ring 5, whereby a closed space 34 is defined by the inner periphery of the inner container 3 and the bypass member 33. In the inner container 3, the side wall in the lower part including the position where the lower end of the bypass member 33 is connected has a thickness smaller than that in the upper part thereof.

Further, the bottom wall of the outer container 2 is provided with an opening 26. Joined to the outer face of the outer container 2 about the opening 26 is a sapphire sheet 23, as a window, having a thickness, e.g., on the order of several hundreds of micrometers, smaller than that of the bottom wall of the outer container 2, so as to close the opening 26. The sapphire sheet 23 has magnetic permeability and translucency. Also, an O ring 24 is disposed between the sapphire sheet 23 and the outer face of the outer container 2 about the opening 26, thereby sealing the joint between the opening 26 and the sapphire sheet 23.

On the other hand, a sapphire rod 6, as a thermal conductor, fixedly penetrates through the bottom wall of the inner container 3 at a position concentric with the opening 26, whereas the resulting penetrated portion is sealed with an adhesive mainly composed of an epoxy resin. One end of the sapphire rod 6 is positioned inside the inner container 3 so as to be in contact with liquid nitrogen 8. The other end of the sapphire rod 6 is disposed within the vacuum heat-insulating layer 4, more specifically at a position outside the inner container 3 facing the sapphire sheet 23. At the other end of the sapphire rod 6, a high transition temperature (high-$T_c$) superconducting magnetic sensor 7, as a superconductor, is installed. In the vicinity of the bottom wall of the outer container 2 therebelow, a sample 40 to be subjected to magnetic measurement is installed so as to face the a high-$T_c$ superconducting magnetic sensor 7 through the sapphire sheet 23.

Connected to the high-$T_c$ superconducting magnetic sensor 7 is a lead 71 for transmitting the magnetic information in the vicinity of the sample 40 obtained by the high-$T_c$ superconducting magnetic sensor 7. The lead 71 travels through an outlet 25, which is formed in the side wall of the inner container 3 so as to be surrounded by the bypass member 33, and is drawn out of the vacuum heat-insulating layer 4 through an outlet 35 formed at the upper part of the bypass member 4, so as to be connected to a signal processing means 90. The outlet 25 is sealed with an adhesive 32 mainly composed of an epoxy resin, whereby the near vacuum state is maintained in the vacuum heat-insulating layer 4. When liquid nitrogen 8 is supplied into the inner container 3 from above the open end thereof, then the cooling apparatus 1 for a superconductor shown in FIG. 1 is obtained.

In thus configured cooling apparatus 1, liquid nitrogen 8 accommodated in the inner container 3 cools the high-$T_c$ superconducting magnetic sensor 7 to the vicinity of liquid nitrogen temperature (about 77 K) by way of the sapphire rod 6. In this cooled state, the high-$T_c$ superconducting magnetic sensor 7 is capable of acting as a magnetic sensor for detecting the weak magnetism induced by the sample 40. Also, since the end portion of the sapphire rod 6 conducting the heat of liquid nitrogen 8 and the high-$T_c$ superconducting magnetic sensor 7 are located within the vacuum heat-insulating layer 4, the high-$T_c$ superconducting magnetic sensor 7 is blocked from heat exchange with the outside. Thus, stable operations are secured in the high-$T_c$ superconducting magnetic sensor 7 since its cooled state is maintained.

Also, since the cooling apparatus 1 has such a structure that the male thread portion 31 of the inner container 3 engages the female thread portion 21 of the outer container 2 so as to connect the outer container 2 and the inner container 3 to each other, the distance between the bottom wall of the outer container 2 and the bottom wall of the inner container 3 can be adjusted easily and freely by changing the engaging position between the thread portions 21, 31. As a consequence, the gap between the high-$T_c$ superconducting magnetic sensor 7 and the sapphire sheet 23 (window) is adjusted easily, so that the distance therebetween is optimized, whereby the sensitivity in measurement of the sample 40 can be enhanced. For example, increasing the amount of screwing of the inner container 3 into the outer container 2 makes the high-$T_c$ superconducting magnetic sensor 7 approach the sapphire sheet 23, so that the distance from the high-$T_c$ superconducting magnetic sensor 7 to the sample 40 can become 1 mm or less, whereby magnetic measurement with a very high sensitivity can be carried out easily and reliably. Since the gap between the high-$T_c$ superconducting magnetic sensor 7 and the sapphire sheet 23 is adjusted by changing the engaging position between the thread portions 21, 31, the position adjusting mechanism having a large number of components and a complicated structure provided in the conventional apparatus is unnecessary. As a consequence, the cooling apparatus 1 can be made inexpensive.

Also, since the sapphire rod 6 (thermal conductor) does not project outside the outer container 2 so as to be elongated, the distance by which the heat of liquid nitrogen 8 is conducted can be shortened, so as to suppress the dissipation of heat. Hence, the performance of cooling the high-$T_c$ superconducting magnetic sensor 7 can be improved. Also, since the sapphire rod 6 is not elongated, the thermal conductor can be made of a single kind of member, i.e., sapphire, whereby the performance of cooling the high-$T_c$ superconducting magnetic sensor 7 can further be improved as compared with the conventional thermal conductor in which different kinds of members are connected to each other.

In addition, since liquid nitrogen 8 can be supplied to the inner container 3 from above the open end thereof, workability at the time of supplying a coolant can be improved. Further, since the containers 2, 3 are connected to each other by simply making the male thread portion 31 of the inner container 3 engage the female thread portion 21 of the outer container 2, the conventional cumbersome operations are not necessary for attaching and detaching the containers 2, 3. As a consequence, the workability at the time of assembling and maintenance can be improved remarkably.

Also, since the lead 71 connected to the high-$T_c$ superconducting magnetic sensor 7 is drawn out of the vacuum heat-insulating layer 4 through the outlet 35 formed at the upper part of the bypass member 33 by way of the outlet 25 of the inner container 3, it is sufficient for the lead 71 to pass through two holes in the same direction in order to be drawn to the outside. Therefore, the operation of passing the lead 71 can be simplified as compared with the conventional operation of making it travel back and forth between two holes, whereby the workability can further be improved.

Further, since the vacuum heat-insulating layer 4 is sealed with the O ring 5 at a part on the inner side of the vacuum heat-insulating layer 4 than the engaging part between the thread portions 21, 31, it can sufficiently keep the vacuum from leaking, i.e., the air from flowing into the vacuum heat-insulating layer 4, from the engaging part. As a consequence, the state of reduced pressure (near vacuum) in the vacuum heat-insulating layer 4 is further favorably held, whereby the cooled state of the high-$T_c$ superconducting magnetic sensor 7 can be maintained further stably.

Also, the bypass member 33 bypasses the flow of the heat from liquid nitrogen 8 conducted through the side wall of the inner container 3, so that the heat of liquid nitrogen 8 escapes from the front side of the O ring 5 in contact with the side wall of the inner container 3 to the vicinity of the upper end of the side wall of the inner container 3, whereby the O ring 5 is sufficiently kept from being cured upon cooling by way of the side wall of the inner container 3. Therefore, the sealing function is prevented from lowering due to the curing of the O ring 5, whereby the state of reduced pressure (near vacuum) in the vacuum heat-insulating layer 4 is further favorably held. As a result, the cooled state of the high-$T_c$ superconducting magnetic sensor 7 can be maintained further stably.

Furthermore, since the inner container 3 is made of GFRP having a thermal conductivity lower than that of metals, the heat of liquid nitrogen 8 can be restrained from being conducted through the inner container 3 and thereby being dissipated to the outside. As a consequence, the performance of holding liquid nitrogen 8 is improved. Also, since the thermal conductivity of the inner container 3 is low as such, the O ring 24 can be restrained from being cooled by the heat conducted through the outer container 2 and the O ring 5 in contact with the inner container 3. Hence, the sealing with the O ring 24 is sufficiently prevented from breaking. Therefore, the state of reduced pressure (near vacuum) in the vacuum heat-insulating layer 4 is further favorably held, whereby the cooled state of the high-$T_c$ superconducting magnetic sensor 7 can be maintained further stably.

Moreover, since the outer container 2 and the inner container 3 are made of GFRP which is nonmagnetic, the magnetic measurement of the sample 40 by means of the high-$T_c$ superconducting magnetic sensor 7 can be prevented from being magnetically affected. Therefore, the weak magnetism in the vicinity of the sample 40 can be detected with a very high accuracy and precision.

Also, since the outlet 25 is disposed so as to be surrounded by the bypass member 33, the sealing portion formed by the adhesive 32 would not be cooled with liquid nitrogen 8 no matter where the fluid level of liquid nitrogen 8 is. Therefore, the sealing portion can be prevented from peeling off due to the difference in thermal expansion coefficients between the adhesive 32 and the inner container 3. As a result, the sealing state is sufficiently held, so that the state of reduced pressure (near vacuum) in the vacuum heat-insulating layer 4 is favorably held, whereby the cooled state of the high-$T_c$ superconducting magnetic sensor 7 can be maintained further stably.

In addition, the lower part of the side wall of the inner container 3 including the position where the lower end of the bypass member 33 is connected has a thickness smaller than that of the upper part, whereas the lower end of the bypass member 33 is connected to this thinner side wall part, whereby the heat can be more likely to flow toward the bypass member 33 than in the thicker upper part of the side wall of the inner container 3. As a consequence, the O ring 5 can further be prevented from curing upon cooling, so that the state of reduced pressure (near vacuum) in the vacuum heat-insulating layer 4 is favorably held, whereby the cooled state of the high-$T_c$ superconducting magnetic sensor 7 can be maintained further stably.

Figure 2:
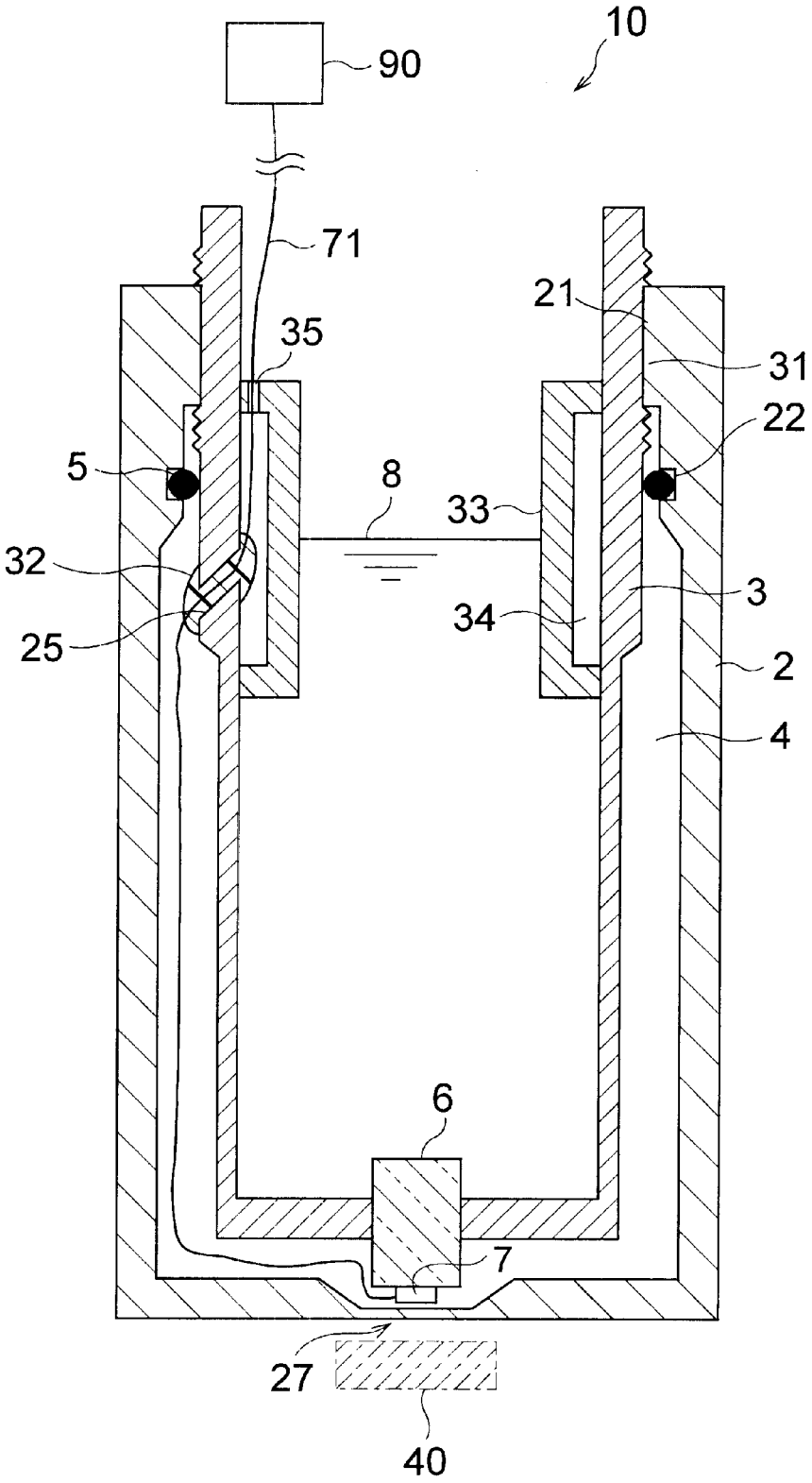
FIG. 2 is a sectional view schematically showing the configuration of a second embodiment concerning the apparatus for cooling a superconductor in accordance with the present invention.

FIG. 2 is a sectional view schematically showing the configuration of a second embodiment concerning the cooling apparatus for a superconductor in accordance with the present invention. As shown in FIG. 2, the window 27 in the cooling apparatus 10 (apparatus for cooling a superconductor) is integrally formed with the outer container 2 by cutting a part of its bottom wall from inside the outer container 2. If the material of the outer container 2 does not have translucency, then the window 27 may not have translucency. However, it is not always necessary for the window 27 to have translucency. Since the window 27 is nonmagnetic as with the outer container 2, magnetic measurement of the sample 40 can be carried out favorably. Also, in the cooling apparatus 10, as with the cooling apparatus 1 shown in FIG. 1, the gap between the window 27 and the high-$T_c$ superconducting magnetic sensor 7 can be optimized by adjusting the amount of screwing of the male thread portion 31 into the female thread portion 21.

Figure 3:
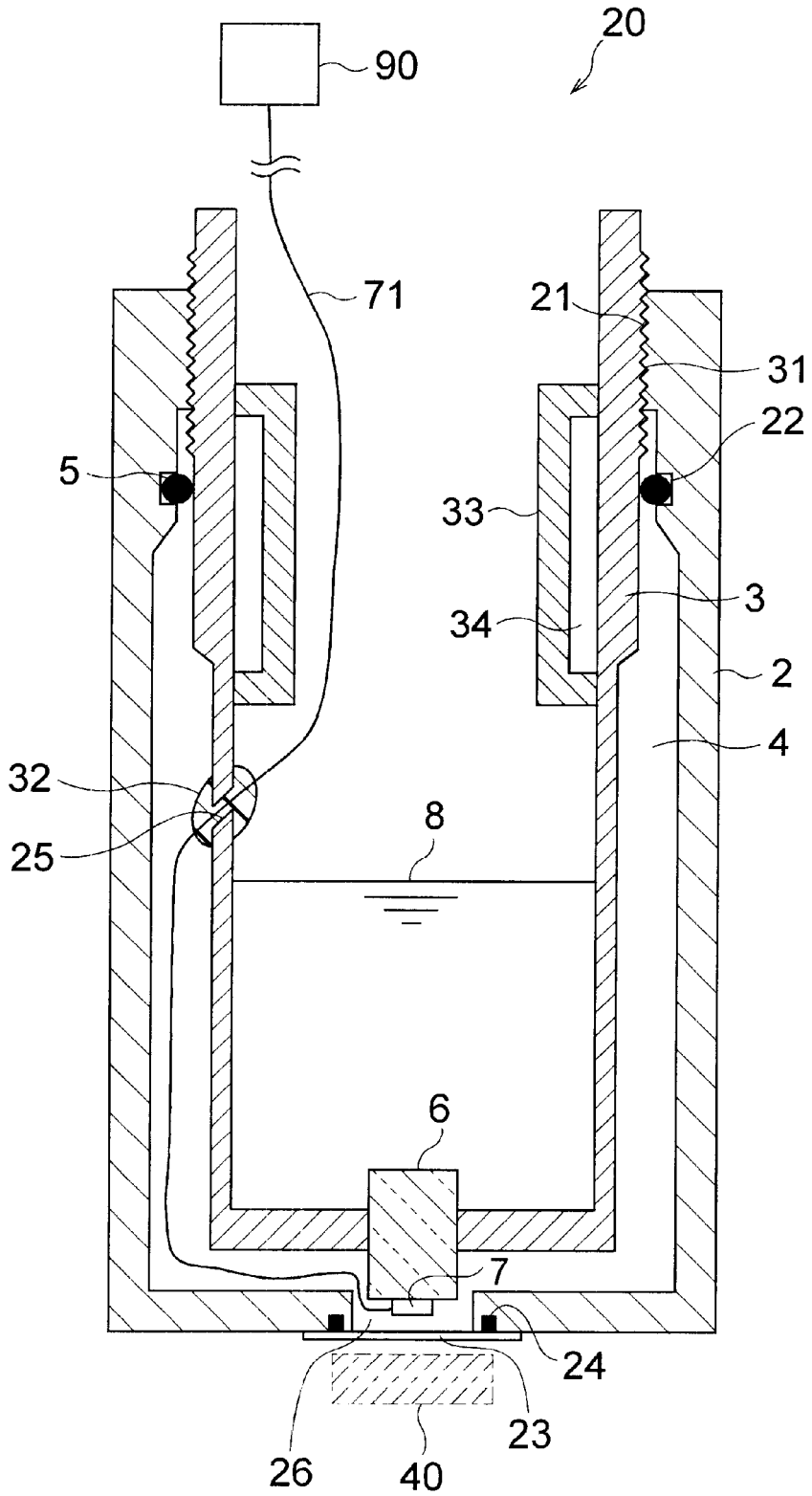
FIG. 3 is a sectional view schematically showing the configuration of a third embodiment concerning the apparatus for cooling a superconductor in accordance with the present invention.

FIG. 3 is a sectional view schematically showing the configuration of a third embodiment concerning the cooling apparatus for a superconductor in accordance with the present invention. In the cooling apparatus 20 (apparatus for cooling a superconductor), as shown in FIG. 3, the outlet 25 is located lower than the lower end of the bypass member 33. Since the cooling apparatus 20 does not necessitate the outlet 35 in the bypass member 33 provided in the cooling apparatus 1 shown in FIG. 1, the manufacture thereof becomes easier, whereby the cooling apparatus 20 can be made less expensive. Also, in this case, it is sufficient for the lead 71 to pass through a single hole in order to be drawn to the outside, whereby the operation of passing the lead 71 can be made simpler than the conventional operation of passing it through two holes. Also, in the cooling apparatus 20, as shown in FIG. 3, the fluid level of liquid nitrogen 8 can be set lower than the outlet 25, so as to sufficiently prevent the sealing portion formed by the adhesive 32 from peeling off.

Figure 4:
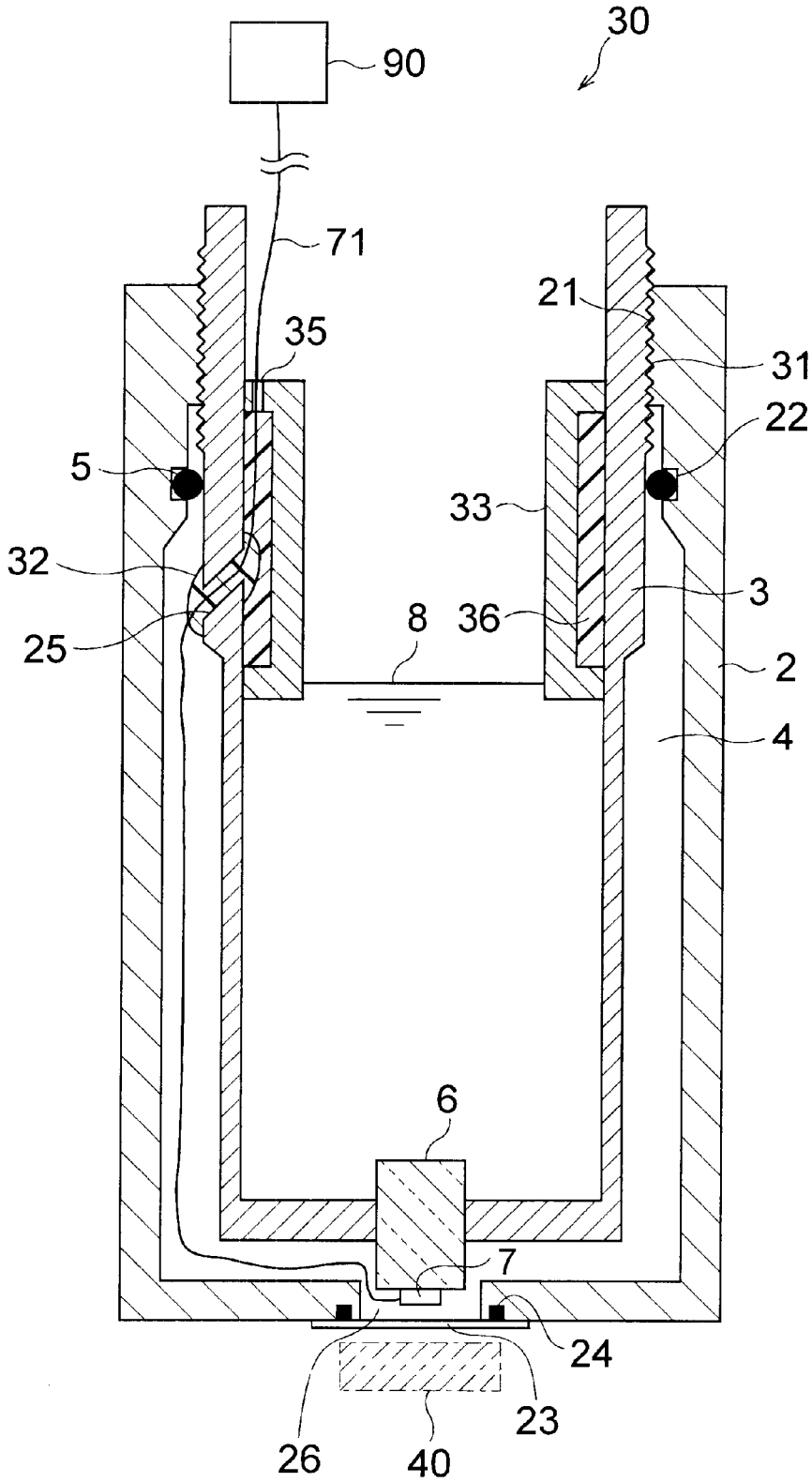
FIG. 4 is a sectional view schematically showing the configuration of a fourth embodiment concerning the apparatus for cooling a superconductor in accordance with the present invention.

FIG. 4 is a sectional view schematically showing the configuration of a fourth embodiment concerning the cooling apparatus for a superconductor in accordance with the present invention. In the cooling apparatus 30 (apparatus for cooling a superconductor), as shown in FIG. 4, the closed space 34 formed in the cooling apparatus 1 shown in FIG. 1 is filled with a heat-insulating material 36 made of urethane foam material or the like, for example. In thus configured cooling apparatus 30, the thermal conduction from the bypass member 33 to the side wall of the inner container 3 is sufficiently blocked by the heat-insulating material 36, whereby the sealing portion formed by the adhesive 32 would not directly be cooled with liquid nitrogen 8. Hence, the sealing portion can be prevented from peeling off due to the difference in thermal expansion coefficients between the adhesive 32 and the inner container 3. As a result, the sealed state is sufficiently held, so that the state of reduced pressure (near vacuum) in the vacuum heat-insulating layer 4 is favorably held, whereby the high-$T_c$ superconducting magnetic sensor 7 can be maintained further stably.

Figure 5:
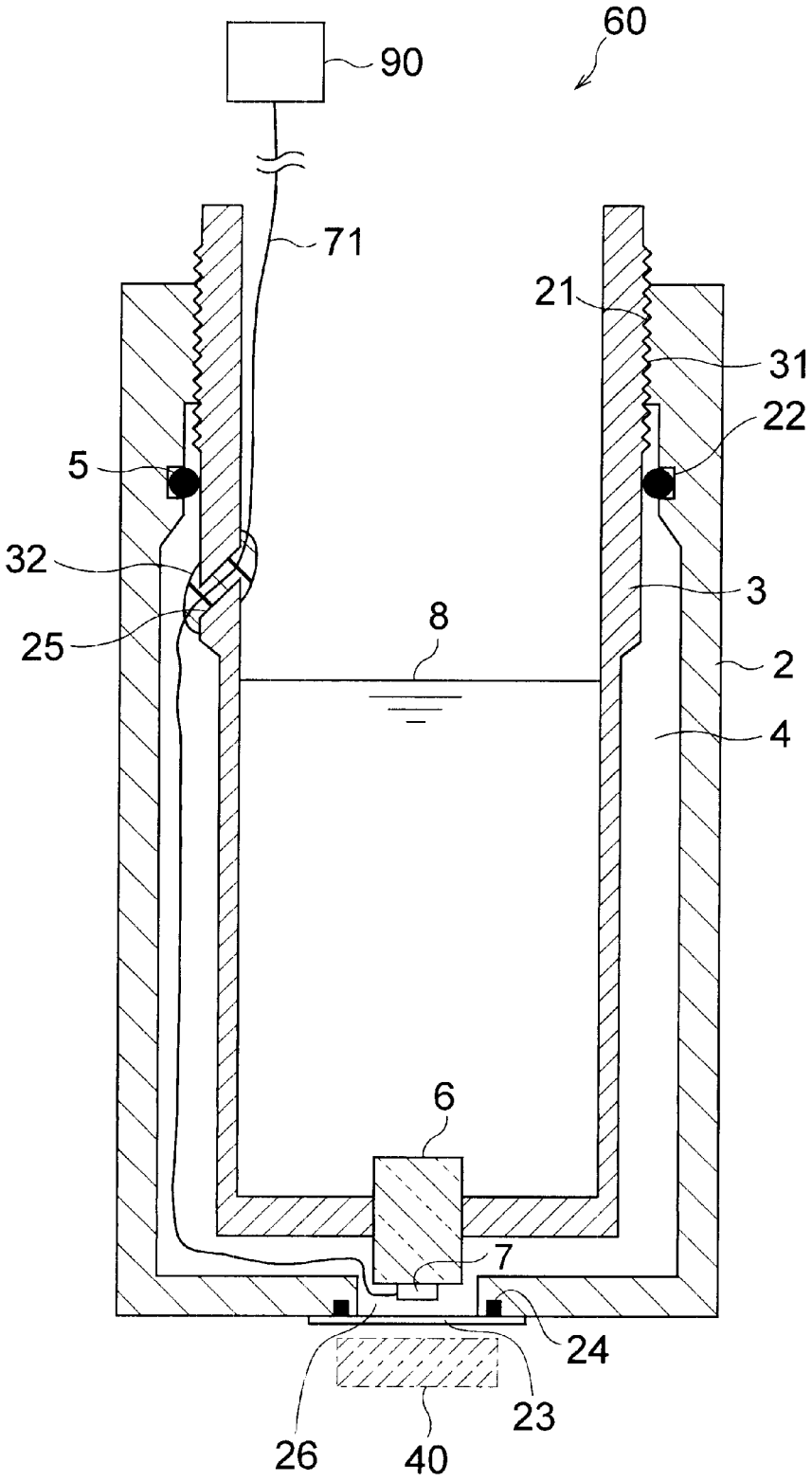
FIG. 5 is a sectional view schematically showing the configuration of a fifth embodiment concerning the apparatus for cooling a superconductor in accordance with the present invention.

FIG. 5 is a sectional view schematically showing the configuration of a fifth embodiment concerning the cooling apparatus for a superconductor in accordance with the present invention. As shown in FIG. 5, the cooling apparatus 60 (apparatus for cooling a superconductor) does not have the bypass member 33 provided in the cooling apparatus 1 shown in FIG. 1. Thus configured cooling apparatus 60 can be made less expensive as there is no bypass member 33. In this case, when the fluid level of liquid nitrogen 8 is set lower than the O ring 5 and the outlet 25 as shown in FIG. 5, the O ring 5 and the adhesive 32 can be kept from being directly cooled, whereby the state of reduced pressure in the vacuum heat-insulating layer 4 can be restrained from deteriorating.

In the above-mentioned cooling apparatus 1, 10, 20, 30, 60, superconductors, e.g., SQUID, other than the high-$T_c$ superconducting magnetic sensor 7 may also be used as their superconductor. Selected as a coolant in this case is one which can attain the superconductivity transition temperature ($T_c$) of the superconductor. Also, the thermal conductor is not limited to the sapphire rod 6, but can be made of any member having such characteristics as excellent thermal conductivity, low coefficient of thermal expansion, and nonmagnetic property, e.g., ruby. Also, the sapphire rod 6 (thermal conductor) may not be shaped like a rod but may be planar, for example. Further, the adhesive 32 for sealing the outlet 25 is not restricted to one mainly composed of an epoxy resin, but may be mainly composed of other unsaturated polyester resins or include organic ingredients in the same kind of the material of the inner container 3. Further, the outlet 25 may be sealed by fusing instead of bonding with the adhesive 32.

Also, in the cooling apparatus 1, 20, 30, 60, the sapphire sheet 23 may be attracted to the outer face of the outer container 2 under vacuum instead of being joined thereto by bonding. The state of reduced pressure in the vacuum heat-insulating layer 4 can be maintained in this manner as well. Also, as a consequence, the amount of adhesive employed can be reduced, and the bonding operation can be omitted. Further, when bonding the sapphire sheet 23 to the outer face of the outer container 2, the O ring 24 may be omitted. As a consequence, the curvature of the sapphire sheet 23 can be decreased under vacuum. Also, the gap between the high-$T_c$ superconducting magnetic sensor 7 and the sapphire sheet 23 can further be narrowed, thereby the distance between the high-$T_c$ superconducting magnetic sensor 7 and the sample 40 can be reduced. Furthermore, the window does not always necessitate translucency as long as it is nonmagnetic.

As explained in the foregoing, the cooling apparatus for a superconductor in accordance with the present invention has such a configuration that the male thread portion of the inner container engages the female thread portion of the outer container so as to connect the inner container and the outer container to each other. As a consequence, the distance between the bottom wall of the outer container and the bottom wall of the inner container can be adjusted easily and freely by changing the engaging position between the thread portions, whereby the gap between the superconductor and the window can be adjusted easily and reliably. Therefore, the conventional position adjusting mechanism having a large number of components and a complicated structure is unnecessary, whereby the apparatus can be made inexpensive. Also, the thermal conductor constituting the cooling apparatus for a superconductor in accordance with the present invention is not elongated like conventional ones, and is made of one kind of member since it is not elongated, whereby the performance of cooling the superconductor can be improved remarkably. Further, since the inner container and the outer container are connected to each other by the engagement between their respective male and female thread portions alone, no cumbersome operation is necessary for attaching and detaching the containers as conventionally required. Therefore, workability can be improved remarkably at the time of assembling and maintaining the apparatus.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An apparatus for cooling a superconductor comprising:

an outer container, substantially shaped like a cup, comprising a female thread portion at an inner peripheral face of an open end thereof and a window at a bottom wall thereof;

an inner container, substantially shaped like a cup and disposed within said outer container, having an outer peripheral face of an open end thereof provided with a male thread portion adapted to engage said female thread portion; and a thermal conductor, disposed at a position facing said window so as to penetrate through said inner container having one end positioned inside said inner container and the other end positioned outside said inner container, the other end having a superconductor attached thereto;

wherein a space between said outer container and said inner container defined by the engagement of said female thread portion and said male thread portion is vacuumed so as to form a vacuum heat-insulating layer.

2. A cooling apparatus for a superconductor according to claim 1, wherein a coolant for cooling said superconductor is accommodated inside said inner container.

3. A cooling apparatus for a superconductor according to claim 1, wherein a lead for transmitting information obtained by said superconductor is connected to said superconductor, and wherein said inner container is formed with an outlet for drawing out said lead therethrough.

4. A cooling apparatus for a superconductor according to claim 1, further comprising an annular sealing member, disposed within said vacuum heat-insulating layer, abutting against both of said inner container and said outer container at a part on the inner side of said vacuum heat-insulating layer than the engaging part of said female thread portion and said male thread portion, so as to seal said vacuum heat-insulating layer.

5. A cooling apparatus for a superconductor according to claim 4, further comprising a bypass member, disposed within said inner container, having one end connected to a part of the inner periphery of said inner container below said sealing member and the other end connected to a part of the inner periphery of said inner container above said sealing member, for bypassing thermal conduction from a coolant with respect to said sealing member.

6. A cooling apparatus for a superconductor according to claim 1, wherein said inner container is made of fiber-reinforced plastics.

* * * * *